US008523614B2

(12) United States Patent
Matsunaga

(10) Patent No.: US 8,523,614 B2
(45) Date of Patent: Sep. 3, 2013

(54) CARD SOCKET

(75) Inventor: Akihiro Matsunaga, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 178 days.

(21) Appl. No.: 12/995,342

(22) PCT Filed: Mar. 27, 2009

(86) PCT No.: PCT/JP2009/001404

§ 371 (c)(1),
(2), (4) Date: Nov. 30, 2010

(87) PCT Pub. No.: WO2009/144865

PCT Pub. Date: Dec. 3, 2009

(65) Prior Publication Data

US 2011/0104920 A1 May 5, 2011

(30) Foreign Application Priority Data

May 30, 2008 (JP) ..... 2008-143614

(51) Int. Cl.
*H01R 24/00* (2011.01)

(52) U.S. Cl.
USPC ..... 439/630

(58) Field of Classification Search
USPC ..... 439/630, 188, 636, 637
See application file for complete search history.

(56) References Cited

U.S. PATENT DOCUMENTS

| | | | | |
|---|---|---|---|---|
| 6,692,276 | B1 | 2/2004 | Abe et al. | |
| 6,994,573 | B2 * | 2/2006 | Tanaka et al. | 439/159 |
| 7,309,258 | B2 | 12/2007 | Anzai et al. | |
| 7,364,820 | B2 | 4/2008 | Tanaka et al. | |
| 7,374,442 | B2 * | 5/2008 | Anzai et al. | 439/188 |
| 7,407,399 | B2 | 8/2008 | Motojima et al. | |
| 7,445,512 | B1 * | 11/2008 | Lai | 439/630 |
| 7,837,488 | B2 * | 11/2010 | Wu | 439/188 |
| 8,123,538 | B2 * | 2/2012 | Xu et al. | 439/188 |
| 2003/0064627 | A1 | 4/2003 | Ooya et al. | |
| 2005/0059281 | A1 | 3/2005 | Bricaud et al. | |
| 2006/0014436 | A1 | 1/2006 | Wu | |
| 2008/0050937 | A1 | 2/2008 | Miyao et al. | |

FOREIGN PATENT DOCUMENTS

| | | |
|---|---|---|
| CN | 101106225 | 1/2008 |
| EP | 1 764 723 A2 | 3/2007 |
| EP | 1 796 227 A1 | 6/2007 |
| JP | 2003-257556 A | 9/2003 |

(Continued)

OTHER PUBLICATIONS

International Search Report dated May 26, 2009 issued in International Appln. No. PCT/JP2009/001404.
Finnish Office Action dated Mar. 30, 2011 (and English translation thereof) in counterpart Finnish Application No. 20106316.
Finnish Office Action dated Nov. 26, 2012 issued in counterpart Finnish Application No. 20106316.

(Continued)

*Primary Examiner* — Phuong Dinh
(74) *Attorney, Agent, or Firm* — Holtz, Holtz, Goodman & Chick, PC

(57) ABSTRACT

[Object] To provide a card socket having a structure that achieves a low profile.

[Solving Means] The base portion of a card frame is basically constituted by a base frame (100) made of metal. Resin is used only for parts where absolutely necessary, such as a housing (200) for retaining contacts (300) and a switch piece holding housing (700) that retains a second switch piece (620). Thus, the resin thickness can be reduced while maintaining the strength of the card socket, so that the structure of the card socket is simplified and a low profile can be achieved.

13 Claims, 6 Drawing Sheets

(56) References Cited

FOREIGN PATENT DOCUMENTS

| | | | |
|---|---|---|---|
| JP | 2005-228518 | A | 8/2005 |
| JP | 2007-141730 | A | 6/2007 |
| JP | 2007-242634 | A | 9/2007 |
| JP | 2008-53124 | A | 3/2008 |
| WO | WO 2006/115184 | A1 | 11/2006 |
| WO | WO 2007/058031 | A1 | 5/2007 |

OTHER PUBLICATIONS

English translation of a Finnish Office Action (dated Nov. 26, 2012 issued in counterpart Finnish Application No. 20106316) which was submitted to the USPTO along with said IDS filed Feb. 22, 2013.

Chinese Office Action dated Apr. 16, 2013 (and English translation thereof) in counterpart Chinese Application No. 200980115827.4.

* cited by examiner

CARD SOCKET

This application is a U.S. National Phase Application under 35 USC 371 of International Application PCT/JP2009/001404 filed Mar. 27, 2009.

TECHNICAL FIELD

The present invention relates to a card socket used for a small-sized electronic device, such as a cellular phone, and more particularly to a card socket for receiving at least part of a card such as a memory card.

BACKGROUND ART

For example, card sockets disclosed in Patent Literatures 1 to 3 have been known as this type of card sockets. Among others, the card socket disclosed in Patent Literature 2 has a structure capable of reducing the thickness of the card socket as compared to the card sockets of Patent Literatures 1 and 3.

Generally, card sockets developed in recent years have a switch for detecting insertion and ejection of a card as with the card socket disclosed in Patent Literature 3.

Patent Literature 1 JP-A 2005-228519
Patent Literature 2 JP-A 2008-53124
Patent Literature 3 JP-A 2007-242634

DISCLOSURE OF INVENTION

Problem(s) to be Solved by the Invention

As described above, an object of the card socket of Patent Literature 2 is to reduce its thickness. However, a housing of the connector has: a function of holding a plurality of members including contacts; a guide portion for guiding a card; and a part that receives a load from a coiled spring. Therefore, the shape of the housing becomes complicated. The housing has thin portions and thick portions at a plurality of locations. It is relatively difficult to form such a housing of resin with a reduced thickness. Furthermore, there is a problem that the strength of a housing having a complicated structure becomes low if the thickness of the card socket is reduced.

Additionally, in the case of the card socket of Patent Literature 2, it is structurally difficult to provide a detection switch as illustrated in Patent Literature 3 without an increase of the size of the card socket.

Therefore, an object of the present invention is to provide a card socket having a simple structure capable of achieving reduction in thickness.

Means to Solve the Problem

According to the present invention, there is provided a first card socket having a base frame made of metal, the base frame having a first part and a second part extending along a first direction and a connection portion connecting the first part and the second part to each other so that the first part and the second part are separated from each other in a second direction perpendicular to the first direction; a housing provided so as to bridge between the first part and the second part of the base frame in the second direction; a contact held on the housing; and a cover made of a metal material that is separate from the base frame, the cover being combined with the base frame so as to cover the housing in a third direction perpendicular to both of the first direction and the second direction, the cover constituting a card receiver for receiving at least part of a card along with the base frame.

Effect(s) of the Invention

According to the present invention, since the contact is held on the housing, which bridges between the first part and the second part of the base frame, the thickness of the card socket can be reduced with a simple structure.

Additionally, according to the present invention, there is no positional limitations that have been imposed on holding portions for holding the contacts of Patent Literature 2. In the card socket of Patent Literature 2, contact portions of the contacts are arranged between held portions and a rear end of the card socket in an insertion direction of a card. The contacts (the contact portions in particular) need to be formed and arranged so as not to interfere with an inserted card when the card is inserted from the rear end toward a front end of the card socket. Specifically, tip portions of the contacts should be bent downward so that the contacts can guide the inserted card smoothly. Without such a configuration, the contact portions of the contacts would be brought into contact with terminals of the card and would possibly be deformed. In such a case, there would be a restriction that a margin is required in the thickness direction. This restriction would limit reduction in thickness of the card socket. In contrast, such a restriction is eliminated if the contacts are arranged so that the contact portions of the contacts are located closer to the front end of the card socket than the held portions of the contacts are. Therefore, according to the present invention, further reduction in thickness can be achieved as compared to the card socket of Patent Literature 2. Moreover, since the base frame of the card socket according to the present invention has the connection portion, the strength is advantageously increased in the second direction as compared to the card socket of Patent Literature 2.

Furthermore, according to the present invention, the first switch piece, which constitutes the detection switch, is formed integrally with the cover. Therefore, even if a normally-closed type detection switch is used, deformation of components of the card socket (e.g., deformation of resin of the housing and positional deviation of the switch pieces caused by such deformation) can be reduced at the time when reflow mounting is carried out. The normally-closed type refers to a type in which the first switch piece and the second switch piece are in contact with each other before the card has been inserted. Particularly, when the backup part is provided on the metal member (e.g., the base frame of the present invention or a metal member separately incorporated in a housing of the prior art), which is combined with the cover, the risk of deformation of the components of the card socket can further be reduced at the time of the reflow mounting. In this case, a force applied to the second switch piece by contact of the first switch piece and the second switch piece is received via the switch piece holding housing in the first direction by the backup part.

DESCRIPTION OF REFERENCE NUMERALS

Figure 1:
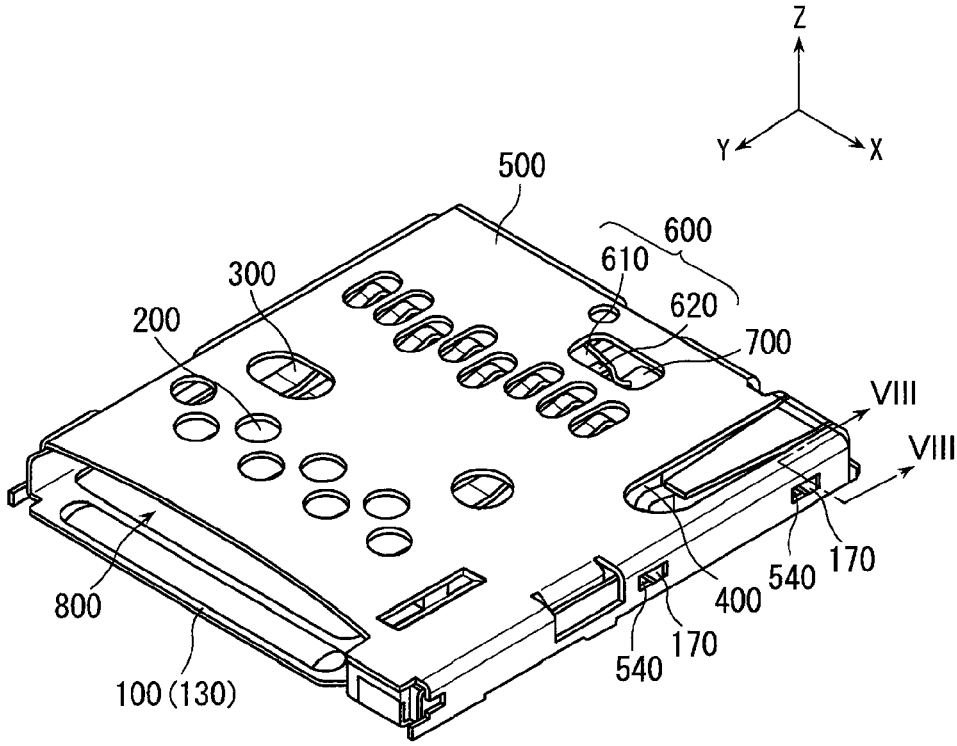
FIG. 1 is a perspective view showing a card socket according to an embodiment of the present invention.

100 Base frame
110 First part
112 Raised portion
114 Through hole
120 Second part
122 Raised portion
124 Recessed portion
130 First connection portion
140 Second connection portion (backup part)
150, 160 Side portion
170 Engaging piece
200 Housing
210 Part
220 Part
300 Contact
310 Spring portion
312 Contact portion
314 Tip portion
320 Held portion
322 Recessed portion
330 Fixed portion
400 Ejection mechanism
410 Slider
420 Cam follower
430 Coiled spring
500 Cover
510 Primary portion
520 Side portion
530 Front portion
540 Engaged hole
600 Detection switch
610 First switch piece
620 Second switch piece
700 Switch piece holding housing
720 Shaft hole
730 Grease stopper
800 Card receiver
900 Card

BEST MODE FOR CARRYING OUT THE INVENTION

A card socket according to an embodiment of the present invention is a card socket for a MicroSD card and is of a so-called push-push type. Particularly, the present invention relates to a card socket mounted on a cellular phone or the like by reflow soldering.

Figure 2:
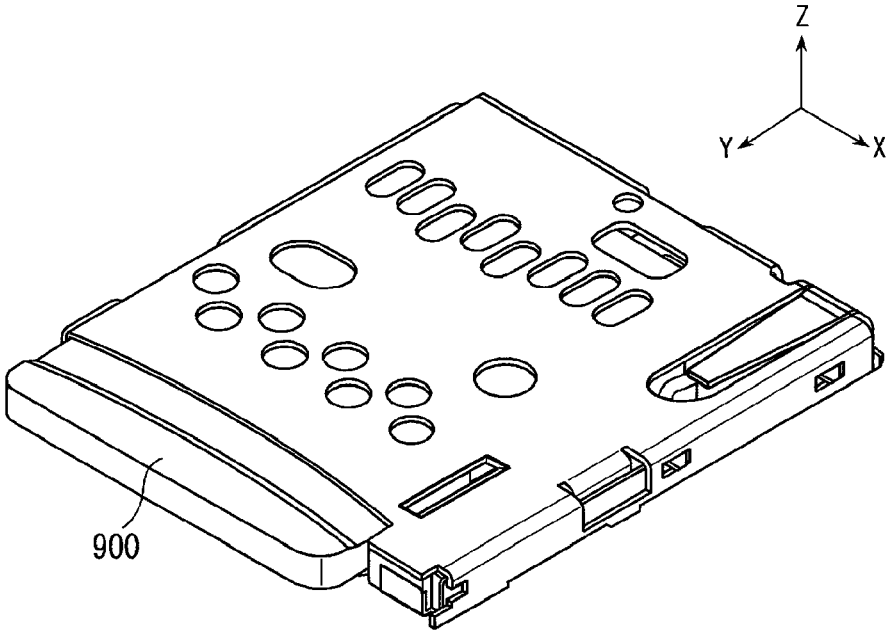
FIG. 2 is a perspective view showing a state in which a card has been received in the card socket of FIG. 1.
Figure 3:
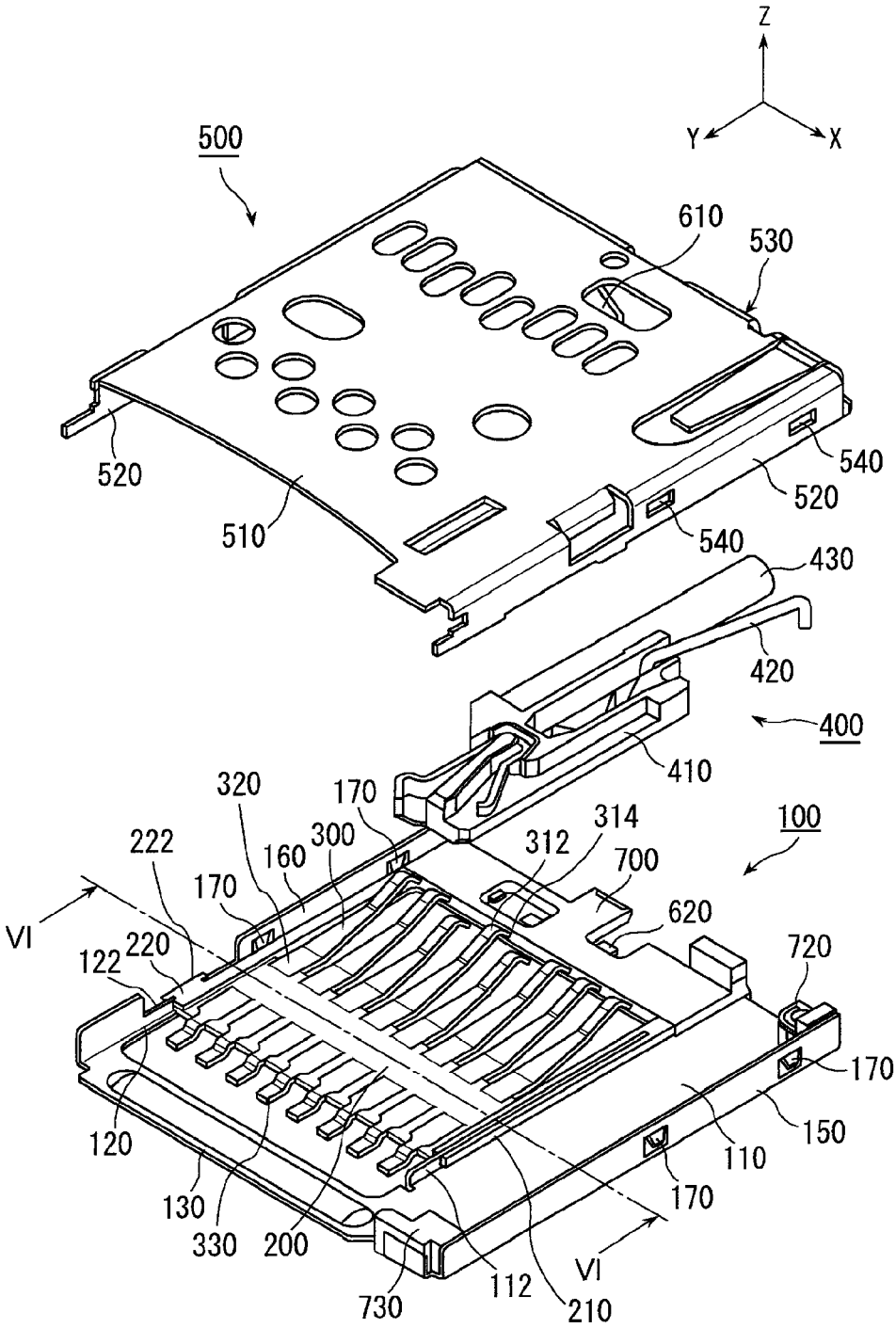
FIG. 3 is an exploded perspective view showing the card socket of FIG. 1.

As shown in FIGS. 1 to 3, the card socket according to this embodiment has a base frame 100 made of metal, a housing 200 supported on the base frame 100, contacts 300 held on the housing 200, an ejection mechanism 400 configured to eject a card 900, a cover 500 made of metal, which covers the housing 200 and the contacts 300, a detection switch 600 configured to detect insertion of the card 900, and a switch piece holding housing 700 for holding part of the detection switch 600. The housing 200 and the switch piece holding housing 700 of this embodiment are made of resin.

Figure 4:
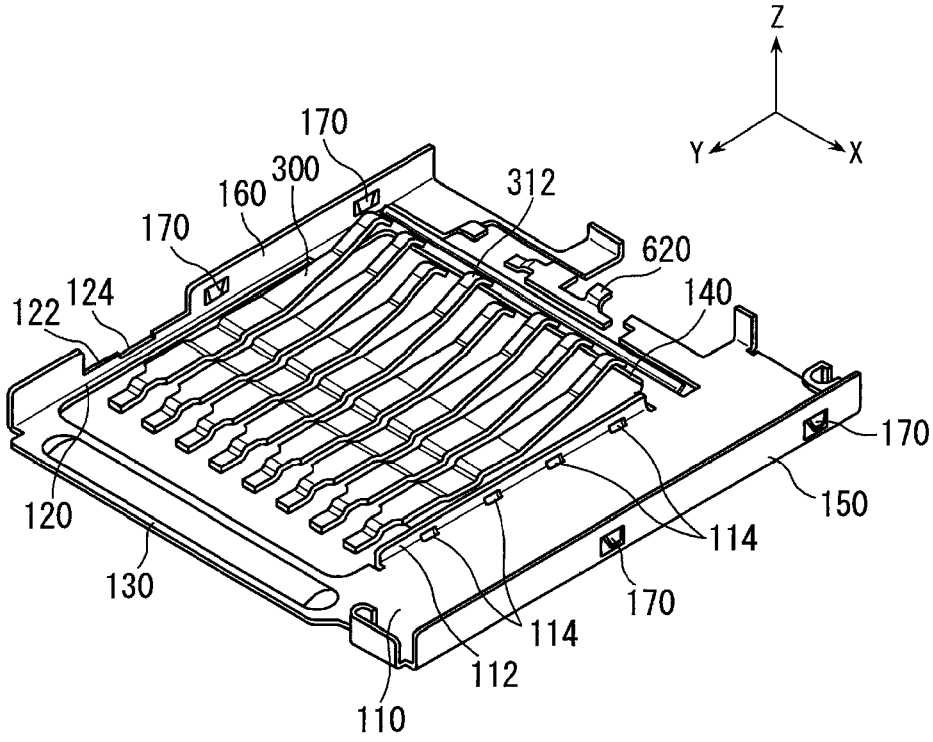
FIG. 4 is a view showing a layout prior to formation of a housing by using a mold-in-place method.

As shown in FIGS. 3 and 4, the base frame 100 includes a first part 110, a second part 120, a first connection portion 130, a second connection portion 140, and side portions 150 and 160. The first part 110 and the second part 120 extend along the Y-direction (first direction). Each of the first connection portion 130 and the second connection portion 140 connects the first part 110 and the second part 120 to each other in a state in which the first part 110 and the second part 120 are spaced from each other in the X-direction (second direction).

The side portion 150 is formed on an outer edge of the first part 110 in the X-direction. The side portion 150 rises in the Z-direction. Meanwhile, a raised portion 112 is formed on an inner edge of the first part 110. The raised portion 112 rises in the Z-direction. Through holes 114 are formed in the raised portion 112. The raised portion 112 serves to prevent the housing 200 from coming off as described later. Furthermore, the raised portion 112 also serves to prevent the base frame 100 from being bent in the Z-direction.

The side portion 160 is formed on an outer edge of the second part 120 in the X-direction. The side portion 160 rises in the Z-direction. A raised portion 122, which rises in the Z-direction, is formed on the outer edge of the second part 120. A recessed portion 124, which is recessed in the Z-direction, is formed in the raised portion 122.

Figure 6:
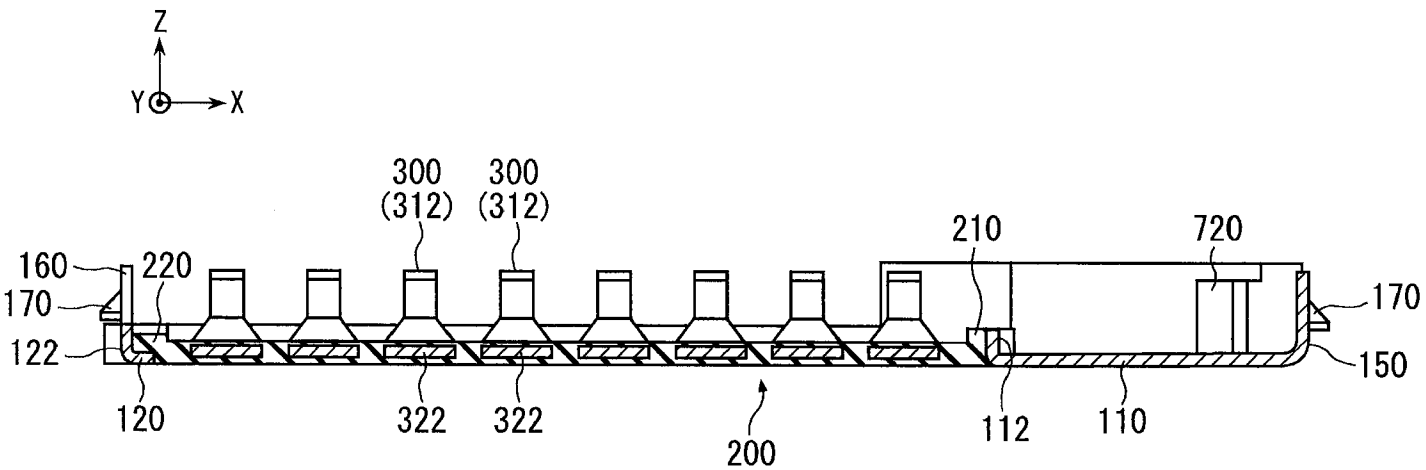
FIG. 6 is a cross-sectional view showing the housing, the contacts, and a base frame taken along line VI-VI of FIG. 3.
Figure 8:
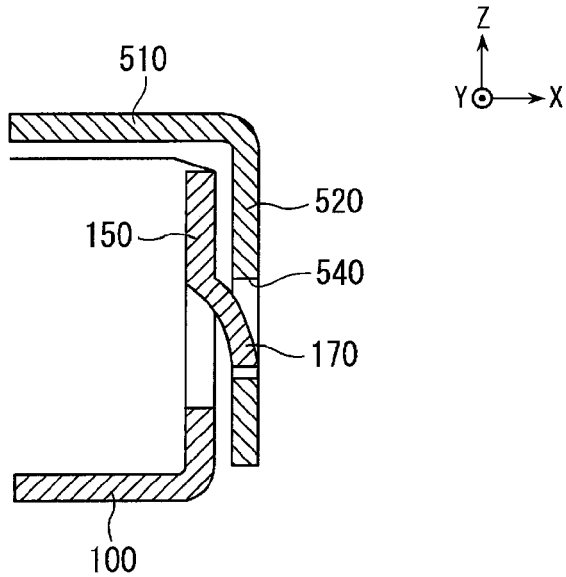
FIG. 8 is a cross-sectional view showing the base frame and the cover taken along line VIII-VIII of FIG. 1.

As shown in FIGS. 4, 6, and 8, engaging pieces 170 are formed on each of the side portions 150 and 160. The engaging pieces 170 project toward an outside of a card slot in the X-direction. As is apparent from FIG. 4, the raised portion 122 of this embodiment is formed as part of the side portion 160.

As shown in FIGS. 3 and 6, the housing 200 extends along the X-direction. The housing 200 is provided so as to bridge a space between the first part 110 and the second part 120 of the base frame 100 in the X-direction. As can be seen from FIGS. 3 and 4, the housing 200 is located between the first connection portion 130 and the second connection portion 140 in the Y-direction. Therefore, as shown in FIGS. 3 and 6, the housing 200 does not overlap the base frame 100 between the first part 110 and the second part 120 in the Z-direction. As can be seen from FIGS. 3, 4, and 6, a part 210 extending along the Y-direction is formed on an end of the housing 200. The part 210 has such a shape as to sandwich the raised portion 112 in the X-direction. Furthermore, the part 210 is also situated within the through holes 114. Thus, the housing 200 is prevented from coming off the first part 110. A part 220 extending along the Y-direction is formed on another end of the housing 200. The part 220 has a part 222 projecting toward an outside of the card socket in the X-direction. That part extends along the Y-direction. Specifically, the part 222 of the housing 200 sandwiches the raised portion 122 in the X-direction. The part 222 of the housing 200 is situated within the recessed portion 124 of the raised portion 122. As is apparent from FIG. 9, the size of the part 222 of the housing 200 is larger than the size of the recessed portion 124 in the Y-direction. Therefore, the housing 200 is also prevented from coming off the second part 120.

Figure 5:
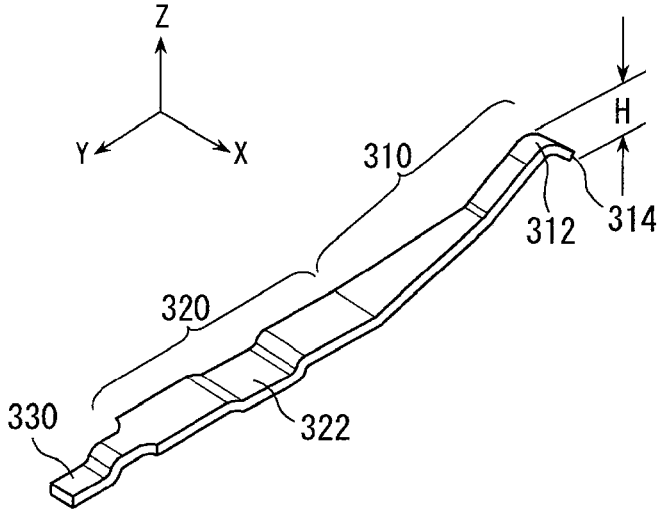
FIG. 5 is a perspective view showing a contact of FIG. 4.

As shown in FIG. 5, the contact 300 has a spring portion 310 having a contact portion 312, a held portion 320 held by the housing 200, and a fixed portion 330 fixed to a pattern on a circuit board on which the card socket is mounted. A recessed portion 322, which is recessed in the Z-direction, is formed on the held portion 320. As shown in FIGS. 3 and 6, the contacts 300 are held on the housing 200 in a state in which the recessed portions 322 are embedded in the housing 200. Thus, the contacts 300 are prevented from coming off the housing 200. Furthermore, as can be seen from FIGS. 3 and 6, the contacts 300 are arranged on a plane that is different from the plane of the first connection portion 130 of the base frame 100. Specifically, the contacts 300 are located at positions that are different from the position of the first connection portion 130 of the base frame 100 in the Z-direction. Accordingly, the first connection portion 130 does not inhibit contact of the contacts 300 and terminals of the card 900. Furthermore, as shown in FIG. 6, the bottom of the housing 200 and the bottoms of the first part 110 and the second part 120 are located on the same plane. Therefore, the thickness of the card socket can be reduced. As shown in FIG. 1, the first connection portion 130 and the cover 500 define an insertion slot in the present embodiment. The insertion slot is located on a rear end of the card socket. In the present embodiment, the card is inserted from the insertion slot toward a front end of the card socket. In other words, the card is inserted into the card socket from the rear end toward the front end of the card socket. The direction from the rear end to the front end of the card socket is referred to as an insertion direction. As shown in FIG. 3, the contact portions 312 of the contacts 300 are located between the held portions 320 and the front end of the card socket in the insertion direction. The fixed portions 330 are located between the held portions 320 and the rear end of the card socket in the insertion direction. With this arrangement, tip portions 314 of the contacts 300 do not inhibit insertion of the card 900. Accordingly, the height H of the contact portions 312 from the tip portions 314 can be reduced in the present embodiment. (For example, the height H can be made zero.) A conventional card socket needs a margin for preventing the tip portions 314 from contacting a circuit board at the time of flexural deformation of the spring portions 310. According to the present invention, however, such a margin can be reduced. Therefore, the thickness of the card socket can be reduced as compared to the card socket as disclosed in Patent Literature 2, which needs a large margin.

Figure 9:
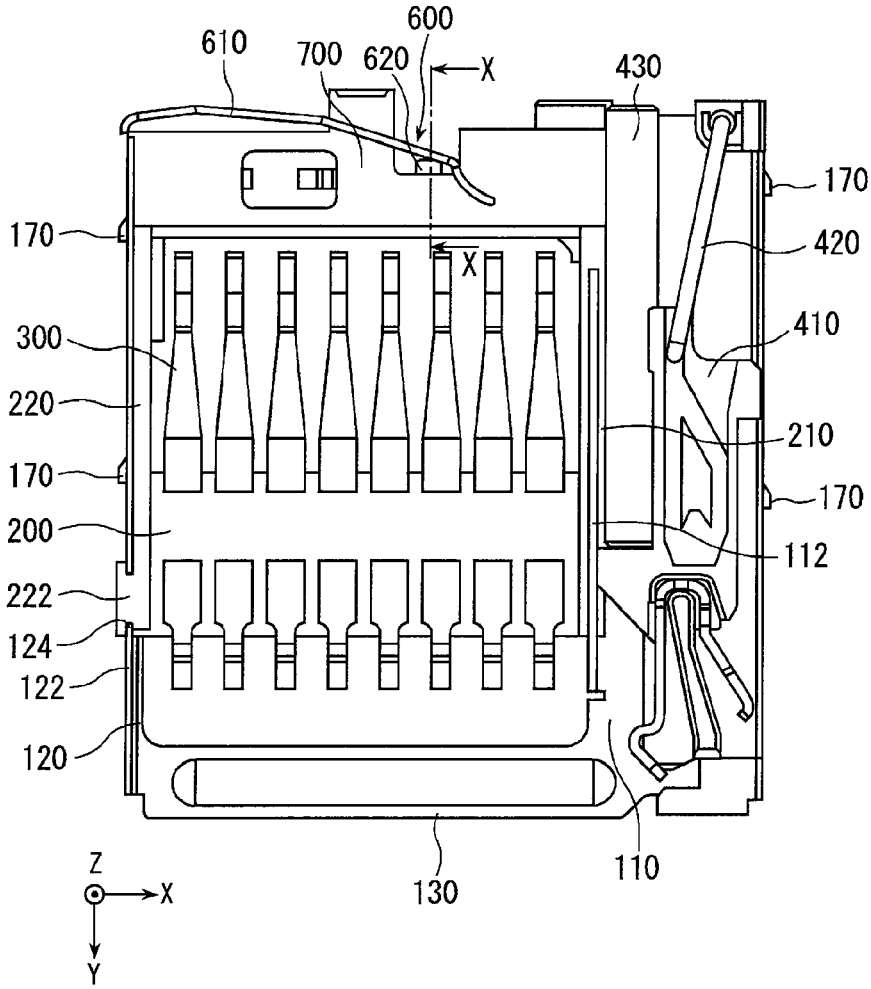
FIG. 9 is a top view showing the card socket of FIG. 1, from which a primary portion of the cover is omitted for clarifying a structure of a detection switch.

As shown in FIGS. 3 and 9, the ejection mechanism 400 of this embodiment includes a slider 410 with a cam, a cam follower 420, and a coiled spring 430. The cam follower 420 follows the cam of the slider 410. The coiled spring 430 biases the slider 410 toward a ejection direction. The ejection mechanism 400 is arranged on the first part 110.

Figure 7:
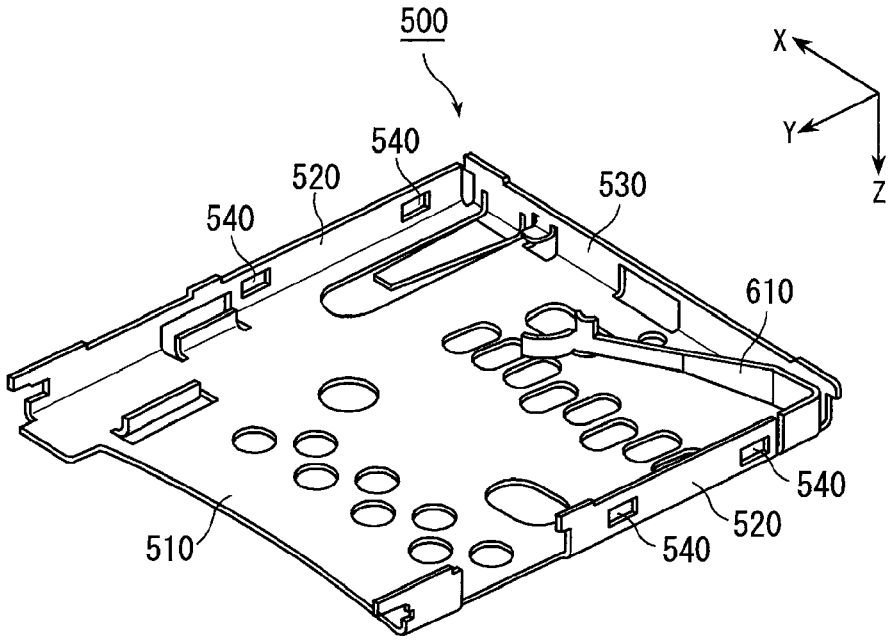
FIG. 7 is a perspective view showing a cover of FIG. 3 as viewed obliquely from below the cover.

As shown in FIGS. 3 and 7, the cover 500 includes a primary portion 510, which forms an upper surface of the card socket, side portions 520, and a front portion 530. The side portions 520 extend along the Z-direction from opposite ends of the primary portion 510 in the X-direction. The front portion 530 extends along the Z-direction from a front end of the primary portion 510. As shown in FIG. 1, the cover 500 and the base frame 100 are combined with each other so as to constitute a card receiver 800. As can be seen from FIGS. 1 and 2, the card 900 is received in the card receiver 800 except a rear end of the card 900. Engaged holes 540 penetrating the side portions 520 in the X-direction are formed in the side portions 520 of the cover 500. As shown in FIGS. 1 and 8, the engaging pieces 170 of the base frame 100 engage with the engaged holes 540. Thus, the combination of the base frame 100 and the cover 500 is maintained. Furthermore, a movement of the base frame 100 relative to the cover 500 is restricted in the Y-direction by the engagement of the engaging pieces 170 and the engaged holes 540.

Figure 10:
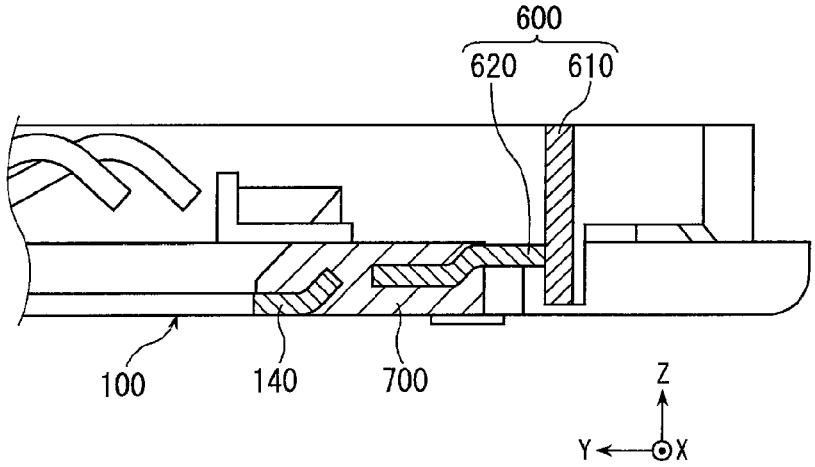
FIG. 10 is a cross-sectional view showing the detection switch taken along line X-X of FIG. 9.

As shown in FIGS. 1 and 9, the detection switch 600 is a normally-closed type switch provided in front of the contacts 300. The detection switch 600 includes a first switch piece 610 and a second switch piece 620. The first switch piece 610 and the second switch piece 620 are brought into contact with each other in the Y-direction. Specifically, with the detection switch 600 of this embodiment, the first switch piece 610 and the second switch piece 620 are in contact with each other when the card 900 has not been inserted. The first switch piece 610 and the second switch piece 620 are out of contact with each other when the card 900 has been inserted. As shown in FIG. 7, the first switch piece 610 is formed integrally with the cover 500. Therefore, the first switch piece 610 has a sufficient spring force. On the other hand, the first switch piece 610 is prevented from being deformed. In contrast, as shown in FIGS. 9 and 10, the second switch piece 620 is held by the switch piece holding housing 700. The switch piece holding housing 700 is supported on the second connection portion 140 of the base frame 100. The present embodiment describes an example in which the base frame 100 is made of metal. However, the first switch piece 610 can also be formed integrally with the cover 500, for example, in a manner similar to a base housing disclosed in Patent Literature 3.

As can be seen from FIG. 10, the second switch piece 620 receives a force from the first switch piece 610 in the Y-direction. The second connection portion 140 serves as a backup part that receives the force via the switch piece holding housing 700. Specifically, since the detection switch 600 of this embodiment is of a normally-closed type, the first switch piece 610 and the second switch piece 620 receive forces from each other in the Y-direction when the card 900 has not been inserted. The force received by the second switch piece 620 is transmitted to the switch piece holding housing 700. If there is no backup part, the switch piece holding housing 700 may be deformed to a large extent by heat at the time when reflow mounting is carried out. According to the present embodiment, however, the second connection portion (backup part) 140 backs up the second switch piece 620 via the switch piece holding housing 700 in the Y-direction. Resin is weak to bending stress and tensile stress but is relatively strong against compressive stress. Therefore, provision of the second connection portion 140 prevents deformation of the switch piece holding housing 700.

Furthermore, the backup part of this embodiment, i.e., the second connection portion 140 is formed as part of the base frame 100. Moreover, the base frame 100 can be combined with the cover 500. Therefore, a force applied to the second switch piece 620 by the first switch piece 610 is transmitted to the engagement portions of the engaging portions 170 and the engaged holes 540 via the switch piece holding housing 700 and the base frame 100. Meanwhile, a force applied to the first switch piece 610 by contact of the first switch piece 610 and the second switch piece 620 is transmitted to the engagement portions of the engaging portions 170 and the engaged holes 540 via the cover 500. As a result, the forces applied to the first switch piece 610 and the second switch piece 620 by contact of the first switch piece 610 and the second switch piece 620 are cancelled at the engagement portions of the engaging portions 170 and the engaged holes 540. In other words, a system of transmission of forces is closed within the card socket. Thus, the balance is maintained within the card socket, and problems such as strain do not arise. In the present embodiment, the backup part is formed as part of the base frame 100 (i.e., the second connection portion 140). However, the backup part may be formed of any metal member that can ultimately be combined with the cover 500. For example, the backup part may be separated from the base frame 100. Specifically, the second connection portion 140 and the side portions 150 and 160 may be formed of a metal member that is separate from the base frame 100. The present embodiment describes an example in which the base frame 100 is made of metal. However, for example, the backup part for the second switch piece 620 of the detection switch 600 may be provided in a structure having a base housing as in Patent Literature 3.

In the present embodiment, the switch piece holding housing 700 is formed integrally with the housing 200. The switch piece holding housing 700 is formed in the same process as a formation process of a housing that serves as an shaft hole 720 for the cam follower 420 and a housing that serves as a grease stopper 730. However, the present invention is not limited to this example. For example, the switch piece holding housing 700 may be formed separately from the housing 200.

As described above, in the embodiment of the present invention, a base part of the card socket is basically formed by the base frame 100 made of metal. In other words, no resin is used except for portions essentially required for holding the contacts 300, maintaining electrical insulation, and the like. Therefore, the thickness of the card socket can be reduced while the strength of the card socket is maintained.

Furthermore, in the embodiment of the present invention, the first connection portion 130 and the second connection portion 140 are provided. Accordingly, the rigidity is maintained in the X-direction. Thus, the strength is improved as compared to the structure of Patent Literature 2.

Additionally, in the embodiment of the present invention, one of the switch pieces (the first switch piece 610), which constitute the detection switch 600, is formed integrally with the cover 500. Therefore, the strength of the detection switch 600 can be improved. Furthermore, for the rest of the switch pieces (the second switch piece 620), the backup part (the second connection portion 140) is provided. Accordingly, it is possible to prevent deformation of resin at the time when reflow mounting is carried out, which would be problematic particularly in a normally-closed type detection switch.

The invention claimed is:

1. A card socket comprising:

a base frame made of metal, the base frame having a first part and a second part extending along a first direction and a connection portion connecting the first part and the second part to each other so that the first part and the second part are separated from each other in a second direction perpendicular to the first direction;

a housing provided so as to bridge between the first part and the second part of the base frame in the second direction;

a contact held on the housing; and a cover made of a metal material that is separate from the base frame, the cover being combined with the base frame so as to cover the housing in a third direction perpendicular to both of the first direction and the second direction, the cover being configured as a card receiver for receiving at least a part of a card along with the base frame;

wherein the base frame is configured such that no portion thereof overlaps the housing between the first part and the second part in the third direction.

2. The card socket according to claim 1, wherein:

the card socket has a front end and a rear end, the card is insertable into the card socket from the rear end toward the front end, the contact has a contact portion that is brought into contact with a terminal of the card and a held portion held on the housing, and the contact is held on the housing such that the contact portion is located between the held portion and the front end of the card socket.

3. The card socket according to claim 1, wherein the connection portion is located at a position that is different from a position of the contact in the first direction.

4. The card socket according to claim 1, wherein at least one of the first part and the second part has a raised portion rising in the third direction, and wherein the housing is formed so as to sandwich the raised portion in the second direction.

5. The card socket according to claim 4, wherein the raised portion has a through hole formed therein, and the housing is situated within the through hole.

6. The card socket according to claim 4, wherein:

a recessed portion recessed in the third direction is formed in a portion of the raised portion that is sandwiched by the housing, a size of the recessed portion in the first direction is smaller than a size of a portion of the housing that sandwiches the raised portion, and the housing is situated within the recessed portion.

7. The card socket according to claim 1, further comprising:

a detection switch for detecting insertion and ejection of the card, the detection switch having a first switch piece formed integrally with the cover and a second switch piece that is brought into contact with the first switch piece in the first direction;

a switch piece holding housing for holding the second switch piece; and a metal member for supporting the switch piece holding housing, the metal member being combined with the cover.

8. The card socket according to claim 7, wherein the metal member has a backup part, and wherein the backup part is arranged so as to receive, via the switch piece holding housing in the first direction, a force applied to the second switch piece by contact of the first switch piece and the second switch piece.

9. The card socket according to claim 7, wherein the metal member comprises one of an engaging portion and an engaged portion, and wherein the cover comprises one of an engaged portion and an engaging portion that engages with the one of the engaging portion and the engaged portion of the metal member in the first direction.

10. The card socket according to claim 7, wherein the metal member is formed integrally with the base frame.

11. The card socket according to claim 1, further comprising:

a card ejection mechanism for ejecting the card received in the card receiver.

12. The card socket according to claim 1, wherein a bottom of the housing, a bottom of the first part, and a bottom of the second part are located on a same plane.

13. A card socket comprising:

a cover partially covering an inserted card;

a detection switch for detecting insertion of the card, the detection switch having a first switch piece formed integrally with the cover and a second switch piece that is brought into contact with the first switch piece in a first direction;

a switch piece holding housing for holding the second switch piece; and a metal member for supporting the switch piece holding housing, the metal member being combined with the cover.

* * * * *